US005770529A

United States Patent [19]

Dennis et al.

[11] Patent Number: 5,770,529

[45] Date of Patent: Jun. 23, 1998

[54] LIQUID-DISTRIBUTION GARMENT

[75] Inventors: Kimberly Bradshaw Dennis, Roswell; Ronald Francis Cook; Craig Farrell Thomaschefsky, both of Marietta, all of Ga.

[73] Assignee: Kimberly-Clark Corporation, Neenah, Wis.

[21] Appl. No.: 430,684

[22] Filed: Apr. 28, 1995

[51] Int. Cl.[6] ..... B32B 27/02; B32B 27/16

[52] U.S. Cl. ..... 442/268; 442/277; 442/286; 442/381; 442/394; 2/46; 2/113

[58] Field of Search ..... 428/233, 284, 428/288, 290, 296, 300; 2/46, 113; 442/381, 394, 268, 277, 286

[56] References Cited

U.S. PATENT DOCUMENTS

| | | | |
|---|---|---|---|
| D. 236,293 | 8/1975 | Banks | D2/17 |
| 2,497,764 | 2/1950 | Doughty | 2/114 |
| 2,579,275 | 12/1951 | Schworm, Jr. | 128/287 |
| 2,976,182 | 3/1961 | Caldwell et al. | 117/135.5 |
| 3,570,012 | 3/1971 | Winters | 2/114 |
| 3,654,632 | 4/1972 | Lacroix | 2/125 |
| 3,720,957 | 3/1973 | Patience | 2/114 |
| 3,973,068 | 8/1976 | Weber | 428/198 |
| 4,070,218 | 1/1978 | Weber | 156/167 |
| 4,298,649 | 11/1981 | Meitner | 428/198 |
| 4,303,712 | 12/1981 | Woodroof | 428/58 |
| 4,338,371 | 7/1982 | Dawn et al. | 428/283 |
| 4,426,417 | 1/1984 | Meitner et al. | 428/195 |
| 4,443,511 | 4/1984 | Worden et al. | 428/198 |
| 4,454,191 | 6/1984 | VonBilcher et al. | 428/244 |
| 4,493,870 | 1/1985 | Vrouenraets et al. | 428/245 |
| 4,537,822 | 8/1985 | Nanri et al. | 428/212 |
| 4,539,255 | 9/1985 | Sato et al. | 428/252 |
| 4,585,449 | 4/1986 | Karami . | |
| 4,670,913 | 6/1987 | Morell et al. | 2/227 |
| 4,705,717 | 11/1987 | Cain et al. | 428/252 |
| 4,713,068 | 12/1987 | Wang et al. | 604/366 |
| 4,725,481 | 2/1988 | Ostapchenko | 428/213 |
| 4,758,239 | 7/1988 | Yeo et al. | 604/366 |
| 4,772,510 | 9/1988 | McClure | 428/286 |
| 4,791,685 | 12/1988 | Maibauer | 2/227 |
| 4,829,602 | 5/1989 | Harreld et al. | 2/51 |
| 4,833,010 | 5/1989 | Langley | 428/287 |
| 4,855,178 | 8/1989 | Langley | 428/287 |
| 4,857,393 | 8/1989 | Kato et al. | 428/289 |
| 4,863,788 | 9/1989 | Bellairs et al. | 428/246 |

(List continued on next page.)

FOREIGN PATENT DOCUMENTS

| | | | |
|---|---|---|---|
| 0 391 661 | 10/1991 | European Pat. Off. | B32B 3/24 |
| 0 599 587 | 6/1994 | European Pat. Off. | A61F 13/15 |
| 0 607 020 | 7/1994 | European Pat. Off. | B32B 7/02 |
| 2 281 072 | 3/1976 | France | A41D 13/02 |
| 2 515 487 | 5/1983 | France | A41D 13/02 |
| 59-159338 | 9/1984 | Japan . | |
| 62-028475 | 2/1987 | Japan . | |
| 62-064833 | 3/1987 | Japan . | |
| 2-276636 | 11/1990 | Japan . | |
| 2 280 357 | 2/1995 | United Kingdom | A41D 13/02 |

OTHER PUBLICATIONS

Patent Abstracts of Japan, vol. 15, No. 221 (C–0838) 6 Jun. 1991 and JP,A, 03 066 366, 22 Mar. 1991.

*Primary Examiner*—Marion E. McCamish
*Assistant Examiner*—Elizabeth M. Cole
*Attorney, Agent, or Firm*—K. V. Sidor

[57] ABSTRACT

A liquid-distribution garment worn in body-side combination with substantially impermeable protective apparel. The garment is composed of at least one layer of a hydrophilically transmuted reinforcing fabric; and at least one layer of a hydrophilically transmuted absorbent nonwoven fabric joined to the layer of reinforcing fabric so that the joined layers have a water wicking rate of at least about 4 centimeters per 30 seconds in at least one direction. The garment may contain a body portion, sleeve portions and/or leg portions, at least one of those portions being formed from the material composed of at least one layer of a hydrophilically transmuted reinforcing fabric and at least one layer of a hydrophilically transmuted absorbent nonwoven fabric. The garment may have sub-portions that contain superabsorbents.

29 Claims, 6 Drawing Sheets

U.S. PATENT DOCUMENTS

| | | | |
|---|---|---|---|
| 4,871,600 | 10/1989 | Amann | 428/56 |
| 4,871,611 | 10/1989 | LeBel | 528/266 |
| 4,872,220 | 10/1989 | Haruvy et al. | 2/243 A |
| 4,908,260 | 3/1990 | Dodia et al. | 428/215 |
| 4,935,287 | 6/1990 | Johnson et al. | 428/198 |
| 4,943,473 | 7/1990 | Sahatjian et al. | 428/245 |
| 4,943,475 | 7/1990 | Baker et al. | 428/246 |
| 4,970,105 | 11/1990 | Smith, Jr. | 428/198 |
| 4,981,738 | 1/1991 | Farnworth et al. | 428/55 |
| 5,021,280 | 6/1991 | Farnworth et al. | 428/102 |
| 5,024,594 | 6/1991 | Athayde et al. | 428/246 |
| 5,042,088 | 8/1991 | Sherrod et al. . | |
| 5,043,209 | 8/1991 | Boisse et al. | 428/233 |
| 5,057,361 | 10/1991 | Sayovitz et al. | 428/290 |
| 5,082,721 | 1/1992 | Smith, Jr. et al. | 428/252 |
| 5,190,806 | 3/1993 | Nomi | 428/198 |
| 5,204,156 | 4/1993 | Lumb et al. | 428/96 |
| 5,208,313 | 5/1993 | Krishnan | 528/28 |
| 5,234,525 | 8/1993 | Krishnan | 156/331.7 |

LIQUID-DISTRIBUTION GARMENT

TECHNICAL FIELD

The present invention relates to garments. More particularly, the present invention relates to garments providing improved comfort.

BACKGROUND

It is often highly desirable to isolate persons from harmful substances which may be present in a work place or accident site. To reduce the chance of exposure, workers would benefit from wearing protective clothing that is substantially impermeable. Generally speaking, protective apparel are resistant to penetration by liquids. In many cases, protective apparel are substantially impermeable to penetration by gases, liquids, airborne particulates and/or pathogens. It is often highly desirable for protective apparel to resist degradation by many harmful chemicals as well as have a very tough construction which minimizes the occurrence of tears, punctures or other openings that could compromise the protection of the wearer.

The very properties of protective apparel that provide the desirable isolation of the wearer's body from the environment can generate conditions under the apparel that may be uncomfortable or even hazardous, especially if the apparel must be worn under high heat index conditions, during vigorous physical activity, or for long periods. Under such conditions, workers typically perspire profusely in response to a hot external environment and/or generated body heat. The protective apparel seals the worker so that heat and moisture cannot escape. In many instances, ventilation holes, ports and/or panels may be relatively ineffective and may compromise the protection of the wearer, especially if complete isolation is required.

Garments worn underneath the protective apparel adds additional insulation that can make a wearer even hotter. Such garments typically become saturated with perspiration. Garments typically worn under substantially impermeable protective apparel include, for example, uniforms made of conventional textiles, sweatshirts made of conventional textiles, undershirts made of conventional textiles, and the like. Garments made of such conventional fabrics may have poor liquid distribution properties. This deficiency may enhance discomfort in critical areas, such as, for example, where limbs (i.e., arms or legs) are attached to the human torso, or other points where perspiration tends to collect causing those areas to become totally saturated with liquid. Furthermore, many of these types of garments are made of natural fibers that take-up liquid into the fiber itself resulting in garments that cling, feel clammy and heavy, may help accelerate the onset of heat stress, and can be very difficult to dry out.

Once saturated with perspiration, conventional garments worn under substantially impermeable protective apparel tend to keep the skin wet which is undesirable for skin wellness as well as tactile comfort. Furthermore, conventional garments requires laundering and other handling which may add cost and inconvenience.

Thus, a need exists for a garment that can be worn underneath substantially impermeable protective apparel and can provide improved comfort to the wearer. A need exists for a garment that can be worn in body-side combination with substantially impermeable protective apparel and which can distribute liquids (e.g., perspiration) to improve the comfort of a wearer. A need also exists for a garment that can be worn in body-side combination with substantially impermeable protective apparel and which is composed substantially or entirely of an inexpensive material such that the garment has desirable liquid distribution properties and is so inexpensive as to be disposable.

DEFINITIONS

As used herein, the term "liquid-distribution garment" refers to a garment that is worn under substantially impervious garments to distribute liquid such as, for example, perspiration which is trapped between the body-side of the impervious garment and the wearer of the impervious garment.

As used herein, the term "body-side combination" refers to the location of an article (e.g., an under-garment) or inner layer of clothing between an exterior article (e.g., an outer-garment) or between an outer layer of clothing and the body of a wearer.

As used herein, the term "hydrophilically transmuted" refers to the condition in which a conventionally hydrophobic material has been rendered hydrophilic or water wettable. This may be accomplished by modifying the surface energies of the hydrophobic material utilizing wetting agents and/or surface modification techniques. Generally speaking, materials such as, for example, fibers, filaments and/or fabrics (e.g., textile fabrics, woven fabrics and the like) formed of typically hydrophobic materials such as polyolefins may be rendered hydrophilic (i.e., water wettable) by use of internal wetting agents that migrate to the surface of the material, external wetting agents that are applied to the surface of the material, and/or surface modification techniques that alter the surface of the material.

As used herein, the term "water capacity" refers to the capacity of a material to absorb aqueous liquid (i.e., water or aqueous solution) over a measured period of time and is related to the total amount of liquid held by a material at its point of saturation. Water capacity is determined by measuring the increase in the weight of a material sample resulting from the absorption of a liquid. Water absorption capacities of samples were measured in accordance with Federal Specification No. UU-T-595C on industrial and institutional towels and wiping papers. A sample size of 4 inches×4 inches The water capacity may be expressed, in percent, as the weight of liquid absorbed divided by the dry weight of the sample as in the following equation:

$$\text{Water Capacity}=[(\text{saturated sample weight}-\text{sample weight})/\text{sample weight}]\times 100$$

The water capacity may also be normalized.

As used herein, the term "wicking rate" refers to the capillarity of a material partially immersed in water. The wicking rate is a rather general and indirect measure of the interaction between a liquid and a solid surface or surfaces that results in an attractive or adhesive force that causes the liquid to move. Wicking rates of samples were measured in accordance with American Converters Standard Analytical Procedure EP-SAP-41.01 which references ASTM D1776 and TAPPI Method UM451. According to this procedure, the wicking rate refers to the rate at which deionized water is drawn in the vertical direction by a strip of an absorbent material.

As used herein, the term "superabsorbent" refers to absorbent materials capable of absorbing at least 10 grams of aqueous liquid (e.g. water, saline solution or synthetic urine Item No. K-C 399105 available from PPG Industries) per gram of absorbent material while immersed in the liquid for 4 hours and holding the absorbed liquid while under a compression force of up to about 1.5 pounds per square inch.

As used herein, the term "nonwoven web" refers to a web that has a structure of individual fibers or filaments which are interlaid, but not in an identifiable repeating manner. Nonwoven webs have been, in the past, formed by a variety of processes known to those skilled in the art such as, for example, meltblowing and melt spinning processes, spunbonding processes and bonded carded web processes.

As used herein, the term "spunbonded web" refers to web of small diameter fibers and/or filaments which are formed by extruding a molten thermoplastic material as filaments from a plurality of fine, usually circular, capillaries in a spinnerette with the diameter of the extruded filaments then being rapidly reduced, for example, by non-eductive or eductive fluid-drawing or other well known spunbonding mechanisms. The production of spunbonded nonwoven webs is illustrated in patents such as Appel, et al., U.S. Pat. No. 4,340,563; Dorschner et al., U.S. Pat. No. 3,692,618; Kinney, U.S. Pat. Nos. 3,338,992 and 3,341,394; Levy, U.S. Pat. No. 3,276,944; Peterson, U.S. Pat. No. 3,502,538; Hartman, U.S. Pat. No. 3,502,763; Dobo et al., U.S. Pat. No. 3,542,615; and Harmon, Canadian Patent No. 803,714.

As used herein, the term "meltblown fibers" means fibers formed by extruding a molten thermoplastic material through a plurality of fine, usually circular, die capillaries as molten threads or filaments into a high-velocity gas (e.g. air) stream which attenuates the filaments of molten thermoplastic material to reduce their diameters, which may be to microfiber diameter. Thereafter, the meltblown fibers are carried by the high-velocity gas stream and are deposited on a collecting surface to form a web of randomly disbursed meltblown fibers. The meltblown process is well-known and is described in various patents and publications, including NRL Report 4364, "Manufacture of Super-Fine Organic Fibers" by V. A. Wendt, E. L. Boone, and C. D. Fluharty; NRL Report 5265, "An Improved device for the Formation of Super-Fine Thermoplastic Fibers" by K. D. Lawrence, R. T. Lukas, and J. A. Young; and U.S. Pat. No. 3,849,241, issued Nov. 19, 1974, to Buntin, et al.

As used herein, the term "microfibers" means small diameter fibers having an average diameter not greater than about 100 microns, for example, having a diameter of from about 0.5 microns to about 50 microns, more specifically microfibers may also have an average diameter of from about 4 microns to about 40 microns.

As used herein, the term "substantially impermeable" refers to material having a hydrostatic head of at least about 80 centimeters as determined in accordance with the standard hydrostatic pressure test AATCCTM No. 127-1977. Generally speaking, material which is substantially impermeable may have a hydrostatic head much greater than 80 centimeters. For example, a substantially impermeable material may have a hydrostatic head of 120 centimeters, 140 centimeters or more.

As used herein, the term "necked material" refers to any material which has been constricted in at least one dimension by processes such as, for example, drawing.

As used herein, the term "neckable material" means any material which can be necked.

As used herein, the term "reversibly-necked material" refers to a necked material that has been treated while necked to impart memory to the material so that when force is applied to extend the material to its pre-necked dimensions, the necked and treated portions will generally recover to their necked dimensions upon termination of the force. A reversibly-necked material may include more than one layer. For example, multiple layers of spunbonded web, multiple layers of meltblown web, multiple layers of bonded carded web or any other suitable combination of mixtures thereof. The production of reversibly-necked materials is illustrated in patents such as, for example, Mormon, U.S. Pat. Nos. 4,965,122 and 4,981,747.

As used herein, the term "stretch direction" refers to the direction in which a reversibly-necked material has recoverable stretch (i.e., the direction of stretch and recovery).

As used herein, the term "consisting essentially of" does not exclude the presence of additional materials which do not significantly affect the desired characteristics of a given composition or product. Exemplary materials of this sort would include, without limitation, pigments, antioxidants, stabilizers, surfactants, waxes, flow promoters, particulates or materials added to enhance processability of a composition.

SUMMARY OF THE INVENTION

The present invention addresses the needs described above by providing a liquid-distribution garment worn in body-side combination with substantially impermeable protective apparel. The liquid-distribution garment is composed of at least one layer of a hydrophilically transmuted reinforcing fabric; and at least one layer of a hydrophilically transmuted absorbent nonwoven fabric joined to the layer of reinforcing fabric so that the joined layers have a water wicking rate of at least about 4 centimeters per 30 seconds in at least one direction (i.e., at least one direction of the joined layers). For example, the joined layers may have a water wicking rate of at least about 5 centimeters per 45 seconds in at least one direction (i.e., at least one direction of the joined layers). As a further example, the joined layers may have a water wicking rate of at least about 6 centimeters per 60 seconds in at least one direction (i.e., at least one direction of the joined layers).

According to the invention, the joined layers may have a water capacity of at least about 8.5 grams for each gram per square meter of basis weight. For example, the joined layers may have a water capacity of at least about 9 grams for each gram per square meter of basis weight.

In one aspect of the invention, the hydrophilically transmuted reinforcing fabric may be selected from hydrophilically transmuted nonwoven fabrics, textile fabrics, knit fabrics, and apertured film-like materials. If the reinforcing fabrics are nonwoven fabrics, they may be selected from spunbonded webs and bonded carded webs.

The reinforcing fabric may be hydrophilically transmuted utilizing an internal wetting agent. Exemplary internal wetting agents include siloxane additives and various surfactants having a (hydrophilic lypophilic balance) HLB number in the range of from 8 to 20 and a molecular weight in the range of from 200 to 4000, that are only semi-compatible with the thermoplastic polymer.

The reinforcing fabric may be hydrophilically transmuted utilizing an external wetting agent. Exemplary external wetting agents include, for example, applied surfactant treatments. Useful surfactants may be selected from, for example, anionic surfactants and cationic surfactants. As an example, dioctylester of sodium sulfosuccinic may be used.

The reinforcing fabric may be hydrophilically transmuted by surface modification. Exemplary surface modification techniques include, for example, corona discharge treatments, chemical etches, coatings, and the like.

In another aspect of the present invention, the hydrophilically transmuted absorbent nonwoven fabric may be selected from hydrophilically transmuted absorbent meltblown fiber webs, spunbonded webs and bonded carded webs. It is contemplated that the meltblown fiber webs and spunbonded webs may also contain additional materials such as, for example, textile fibers, pulp fibers and particulate materials. It is further contemplated that the bonded carded webs may include materials such as, for example, pulp fibers and particulate materials.

According to the present invention, the absorbent nonwoven fabric may be hydrophilically transmuted utilizing an internal wetting agent. Exemplary internal wetting agents include siloxane additives and various surfactants having a (hydrophilic lypophilic balance) HLB number in the range of from 8 to 20 and a molecular weight in the range of from 200 to 4000, that are only semi-compatible with the thermoplastic polymer.

The absorbent nonwoven fabric may be hydrophilically transmuted utilizing an external wetting agent. Exemplary external wetting agents include, for example, applied surfactant treatments. Useful surfactants may be selected from, for example, anionic surfactants and cationic surfactants. As an example, dioctylester of sodium sulfosuccinic may be used. The absorbent nonwoven fabric may be hydrophilically transmuted by surface modification. Exemplary surface modification techniques include, for example, corona discharge treatments, chemical etches, coatings, and the like.

According to the invention, the liquid-distribution garment worn in body-side combination with substantially impermeable protective apparel may contain a body portion, sleeve portions and/or leg portions, at least one of those portions being formed from the material composed of at least one layer of a hydrophilically transmuted reinforcing fabric and at least one layer of a hydrophilically transmuted absorbent nonwoven fabric joined to the layer of reinforcing fabric so that the joined layers have a water wicking rate of at least about 4 centimeters per 30 seconds. In an aspect of the present invention, the portions may contain sub-portions or sub-sections that include superabsorbents that soak up liquids such as, for example, perspiration. According to the present invention, the liquid-distribution garment may be composed of multiple sections including a top section comprising a body portion and sleeve portions extending therefrom, and a bottom section comprising leg portions.

One embodiment of the present invention encompasses a liquid-distribution garment worn in body-side combination with substantially impermeable protective apparel, the garment includes a first body half and a second body half, said second body half being substantially a mirror image of said first body half, each said body half being composed of a seamless sheet of material comprising at least one layer of a hydrophilically transmuted reinforcing fabric; and at least one layer of a hydrophilically transmuted absorbent nonwoven fabric joined to the layer of reinforcing fabric so that the joined layers have a water wicking rate of at least about 4 centimeters per 30 seconds, and each body half includes: 1) a body portion having a first and second edge and a top edge extending approximately half-way across the body portion from the top of the second edge; 2) a sleeve portion having a top and bottom sleeve edge, a top edge, and a segment of the second edge of the body portion; and 3) a leg portion having a front and a rear leg edge; 4) closure means joining the first edges of each body portion on each body half; 5) a seam joining the second edges of the body portion, including the segment of the second edges in the sleeve portions, on each body half; 6) sleeve seams joining the top sleeve edges to the bottom sleeve edges on each body half; 7) inseams joining the front leg edges to the back leg edges on each body half; and 8) back seams joining each top edge of a sleeve portion with the top edge of its respective body portion on each body half.

In an aspect of the present invention, the garment may include sub-portions or sub-sections that include superabsorbents that soak up liquids such as, for example, perspiration.

Generally speaking, seams in the garment may be, for example, conventional stitched seams or seams provided by ultrasonic welding, solvent welding, thermal welding or the like. The closure means may be any suitable closure mechanism such as, for example, zippers, button fasteners, clip fasteners, snap fasteners, hook and loop fasteners and the like.

DETAILED DESCRIPTION

Figure 1:
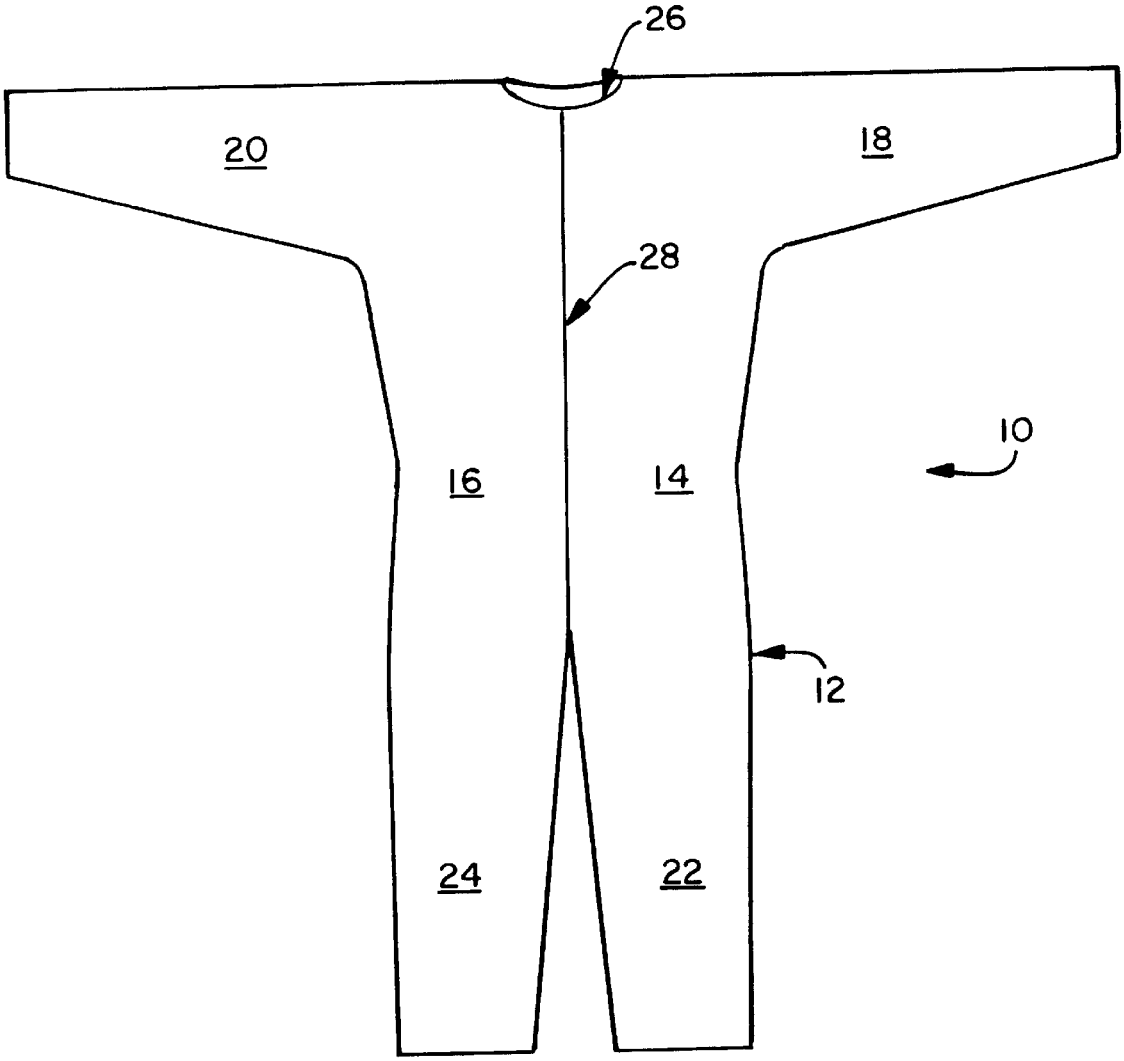
FIG. 1 illustrates a front view of an exemplary liquid-distribution garment.

The present invention is directed to a liquid-distribution garment. FIG. 1 illustrates at 10 a front view of an exemplary liquid-distribution garment. The particular illustration depicts an exemplary liquid-distribution garment having a reduced number of seams and a seamless shoulder construction.

The liquid-distribution garment 12 include a first body half 14 and a second body half 16. Desirably, each body half 14 and 16 is formed from a seamless sheet of material. The second body half 16 is substantially a mirror image of the first body half 14. The liquid-distribution garment contains sleeves 18 and 20 as well as legs 22 and 24. A neck opening 26 is visible at the top of the garment 12. As shown in FIG. 1, only a closure means 28 is visible from a front view of the coveralls 12.

Figure 2:
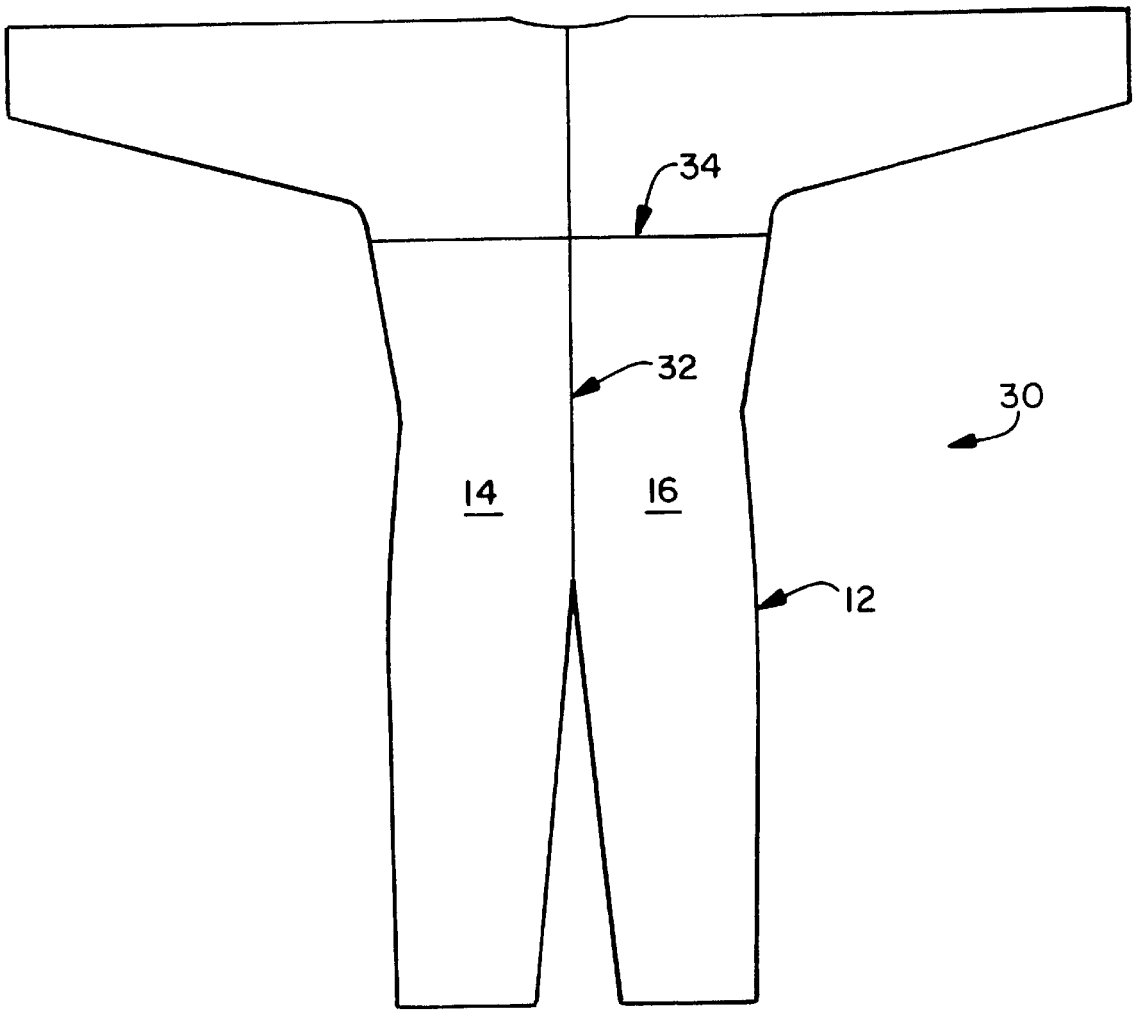
FIG. 2 illustrates a rear view of an exemplary liquid-distribution garment.

FIG. 2 illustrates at 30 a rear view of the exemplary liquid-distribution garment 12. The garment 12 includes a first body half 14 and a second body half 16 (in reversed position as the view is from the rear). The sleeves 18 and 20 and the legs 22 and 24 are also in reversed position. As shown in FIG. 2, only a vertical seam 32 and a back seam 34 are visible from a rear view of the garment 12.

Figure 3:
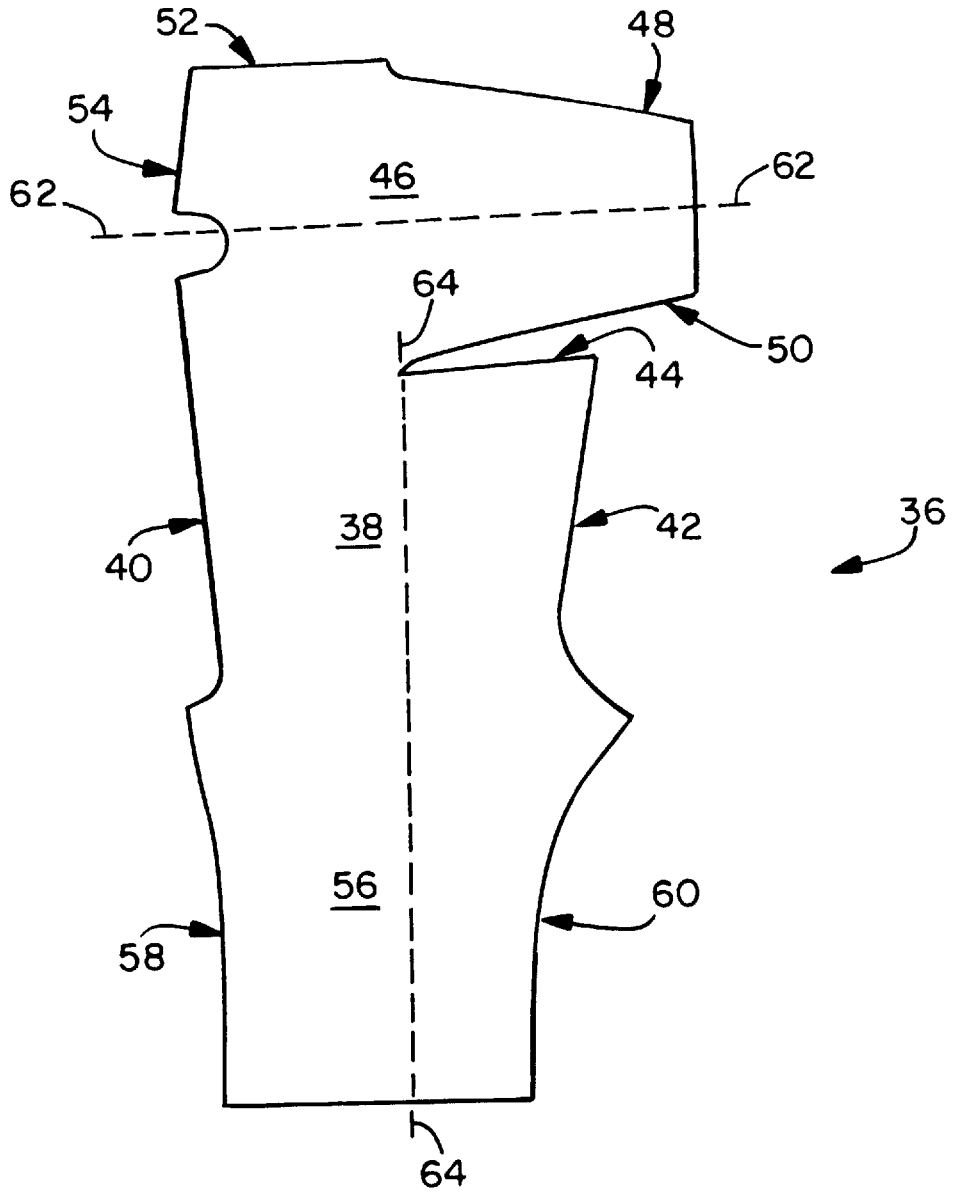
FIG. 3 illustrates a detail of an exemplary liquid-distribution garment.

Referring now to FIG. 3, there is shown at 36 a sheet of material used to form a body half 14. Desirably, this sheet of material is a seamless sheet of material. The body half 14 includes a body portion 38 having a first edge 40, a second edge 42 and a top edge 44. The top edge 44 extends approximately half-way across the body portion 38 from the top of the second edge 42.

The body half 14 includes a sleeve portion 46 having a top sleeve edge 48 and bottom sleeve edge 50, a top edge 52, and a segment 54 of the second edge 42 of the body portion 38. The body half 14 also includes a leg portion 56 having a front leg edge 58 and a rear leg edge 60.

Figure 5:
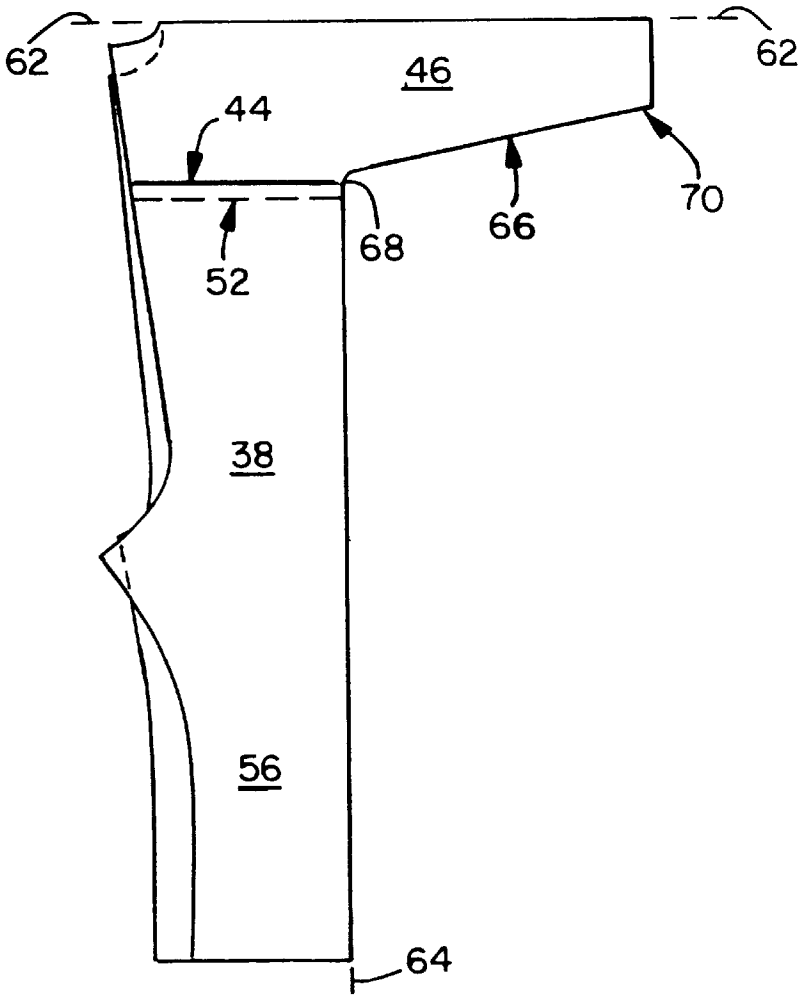
FIG. 5 illustrates a detail of an exemplary liquid-distribution garment.
Figure 4:
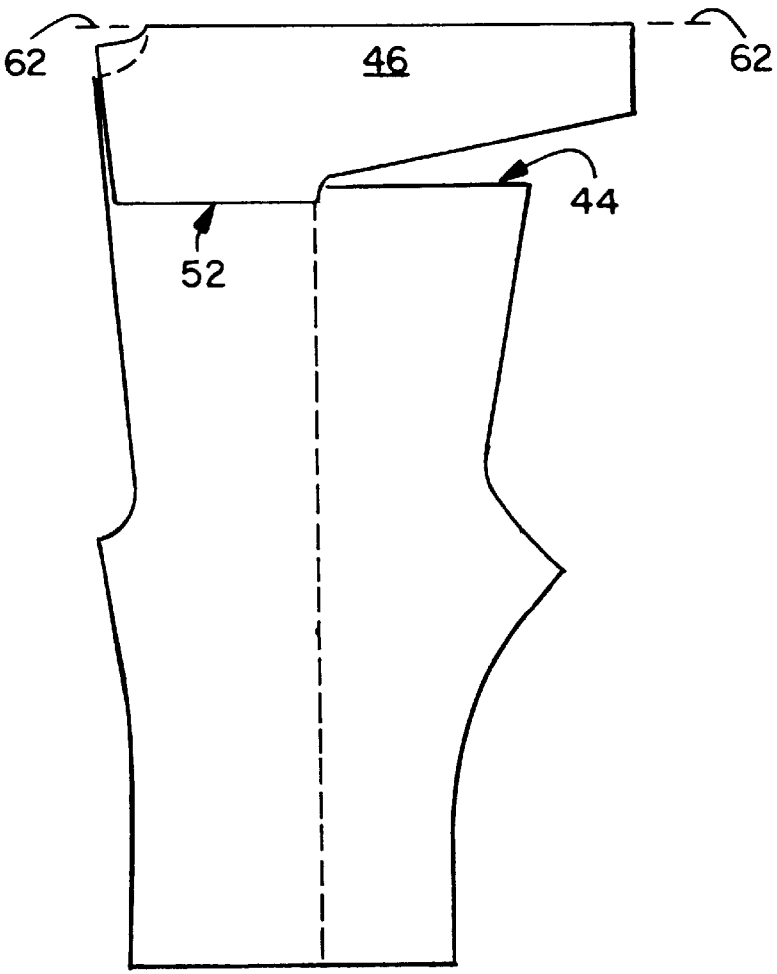
FIG. 4 illustrates a detail of an exemplary liquid-distribution garment.

A sleeve 18 of a body half 14 may be constructed by folding the sleeve portion 46 along line 62 as illustrated in FIG. 4. Next, the body portion 38 and leg portion 56 are folded along line 64 as illustrated in FIG. 5.

After these two folds are made, the top edge 52 of the sleeve portion 46 is attached to the top edge 44 of the body portion 38 producing a back seam 34 which can be seen in FIG. 1. Referring again to FIG. 5, the sleeve portion 46 is closed into a sleeve 18 by attaching the top sleeve edge 48 to the bottom sleeve edge 44 producing a sleeve seam 66 running from point 68 to point 70.

Figure 6:
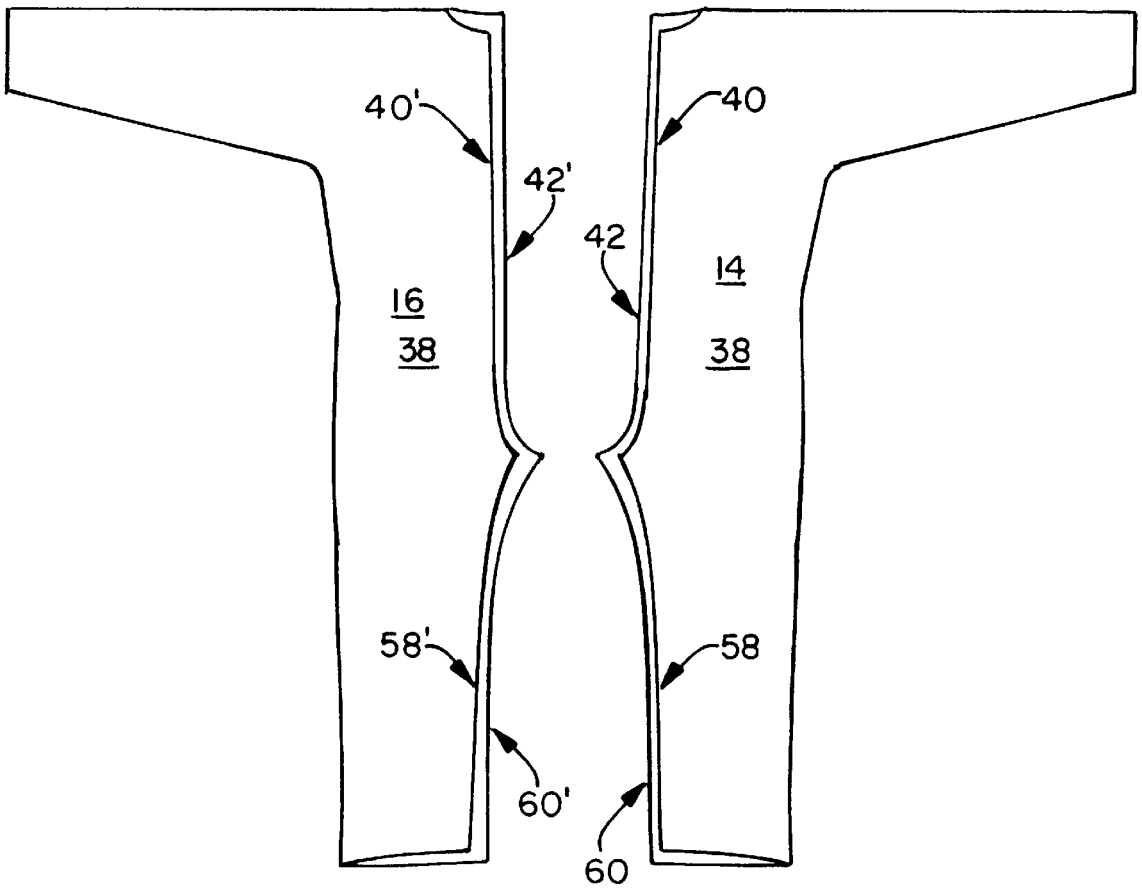
FIG. 6 illustrates a detail of an exemplary liquid-distribution garment.

Generally speaking, this operation would be performed on the other body half 16 following exactly the same procedure as it would apply to the mirror image shape. Referring now to FIG. 6, the body half 14 is attached to body half 16 (i.e., the mirror image of body half 14). The body halves are joined by attaching the respective second surfaces 42 and 42' of the body portions 38 and 38'. A closure means (e.g., zipper, button fasteners, clip fasteners, snap fasteners, hook and loop fasteners and the like) 28 is attached to the respective first surfaces 40 and 40'. The leg portions are closed by attaching the front leg edge 58 to the back leg edge 60 and the front leg edge 58' to the back leg edge 60' on each body half.

At this point other features may be added such as, for example, a collar, hood, boots and/or elastic cuffs at the wrists and/or ankles of the garment.

When this exemplary method of construction is utilized, the liquid-distribution garment contains approximately eight seams and a closure. More particularly, body halves are united into garment by: 1) a closure joining the first edges of each body portion on each body half; 2) a seam joining the second edges of the body portion, including the segment of the second edges in the sleeve portions, on each body half; 3) sleeve seams joining the top sleeve edges to the bottom sleeve edges on each body half; 4) inseams joining the front leg edges to the back leg edges on each body half; and 5) back seams joining each top edge of a sleeve portion with the top edge of its respective body portion on each body half.

The garment includes a neck opening in a shoulder line at its top. The neck opening may be fitted with a collar and/or hood. Sleeve and leg portions extending from the body portion may be fitted with elastic cuffs and/or other elastic means to ensure that they fit snugly against a wearer.

Desirably, this construction contains as few seams as possible. It is thought that the presence of seams may interfere with the distribution of liquid. That is, the presence of a seam may create a barrier for liquid wicking or other forms of liquid distribution.

Figure 7:
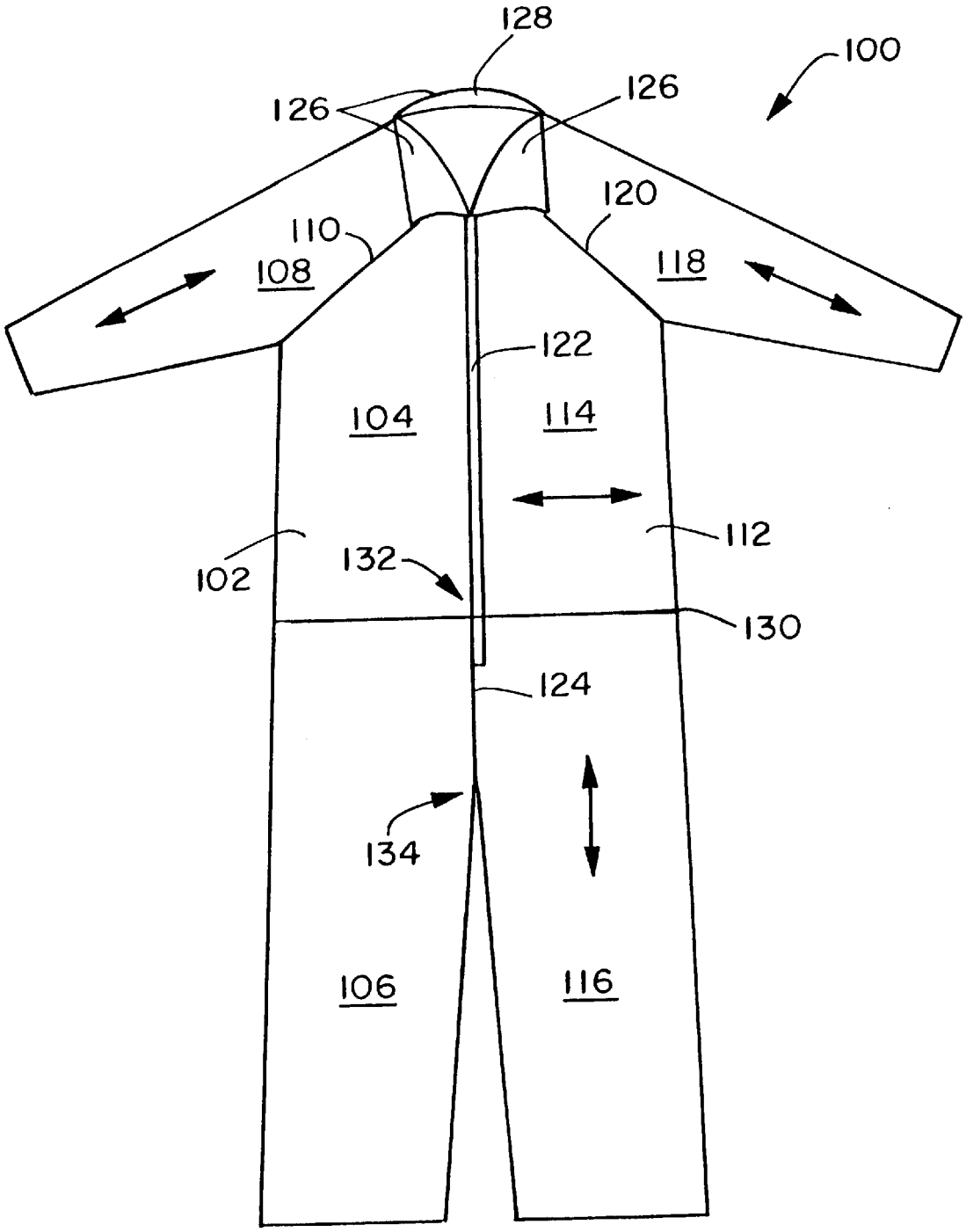
FIG. 7 illustrates a front view of an exemplary liquid-distribution garment.

FIG. 7 schematically illustrates another exemplary embodiment of the liquid-distribution garment 100 of the present invention. The particular illustration depicts an exemplary liquid-distribution garment having several seams and a more conventional coverall-style construction. The liquid distribution garment 100 contains a left panel 102 which includes a left body portion 104 and a left leg portion 106. The garment contains a left sleeve portion 108 which is joined to the left panel 102 by a seam 110. The garment also contains a right panel 112 which includes a right body portion 114 and a right leg portion 116. The garment contains a right sleeve portion 118 which is joined to the right panel 112 by a seam 120. The left panel 102 and the right panel are joined by a zipper closure 122 and a seam 124. A collar 126 is attached by a seam 128. Desirably, left panel 102 and right panel 112 are constructed so that seam 130 joins an upper half 132 and a lower half 134.

If the liquid-distribution garment is composed of a stretchable liquid-distribution material, the direction of stretch of the stretchable material in the upper half 132 may correspond to the direction indicated by the arrows associated therewith. The direction of stretch of the stretchable material in the lower half 134 may correspond to the direction indicated by the arrows associated therewith. Similarly, a desired stretch direction of sleeve portions 108 and 118 may correspond to the direction indicated by the arrows associated therewith. Differing constructions are contemplated and various seams and panels of other possible constructions are not shown. An exemplary construction is set forth in U.S. Pat. No. 4,670,913, assigned to the assignee of the present invention and incorporated herein by reference. Suitable stretchable materials that may be used in the manufacture of the liquid-distribution garments of the present invention include, for example, reversibly-necked materials. Such materials are necked, non-elastomeric materials that have been treated while necked to impart memory to the material so that when force is applied to extend the material to its pre-necked dimensions, the necked and treated portions will generally recover to their necked dimensions upon termination of the force. Such reversibly-necked materials may include more than one layer. For example, multiple layers of spunbonded web, multiple layers of meltblown web, multiple layers of bonded carded web or any other suitable combination of mixtures thereof may be used. The production of reversibly-necked materials is illustrated in patents such as, for example, Mormon, U.S. Pat. Nos. 4,965,122 and 4,981,747, the contents of which are incorporated herein by reference.

Generally speaking, the manufacture of the liquid-distribution garments of the present invention may be in accordance with known automated, semi-automated, or hand assembly procedures. For example, attachment of the various portions of the garments may be achieved utilizing sewing or stitching, ultrasonic bonding, solvent welding, adhesives, thermal bonding and similar techniques.

The order of manufacturing steps described above (i.e., with respect to FIGS. 1–6) are believed to provide an efficient process for fabricating liquid-distribution garments. However, it is contemplated that changes in the order of these steps may be made without departing from the spirit and scope of the present invention.

Desirably, the material used in the construction of the liquid-distribution garment may be one or more bonded seamless sheets of material formed from carded webs, webs of spunbonded filaments, webs of meltblown fibers. The sheet material may also be one or more knit or woven materials, Desirably, such textile-type materials are seamless knit or woven materials.

The sheet material (e.g., nonwoven webs, woven materials, knit materials or films) may be formed from polymers such as, for example, polyamides, polyolefins, polyesters, polyvinyl alcohols, polyurethanes, polyvinyl chlorides, polyfluorocarbons, polystyrenes, caprolactams, poly(ethylene vinyl acetates), ethylene n-butyl acrylates, and cellulosic and acrylic resins. If the nonwoven web is formed from a polyolefin, the polyolefin may be polyethylene, polypropylene, polybutene, ethylene copolymers, propylene copolymers and butene copolymers.

The sheet material (e.g., the seamless nonwoven webs, woven materials, knit materials or films) may have a basis weight ranging from about 15 gsm (~0.4 osy) to about 300 gsm (~9 osy). For example, the sheet material may have a basis weight ranging from about 25 gsm (~0.7 osy) to about 100 gsm (~3 osy). Desirably, the sheet material may have a basis weight ranging from about 20 gsm (~0.6 osy) to about 75 gsm (~2 osy).

An exemplary reinforcing fabric that can be used in the manufacture of the liquid distribution garment of the present invention is a spunbonded polypropylene continuous filament web. This material can be formed utilizing a conventional spunbonding process and is available from the Kimberly-Clark Corporation, Neenah, Wisconsin. The production of spunbonded nonwoven webs is illustrated in patents such as, for example, Appel et al. and others which have previously been incorporated by reference.

Another exemplary reinforcing fabric and/or absorbent fabric is a high pulp content spunbonded continuous filament composite. Such a material may have a wide range of basis weights and can be composed of about 84 percent, by weight, pulp and about 16 percent, by weight, spunbonded polypropylene continuous filament web. This material can be formed essentially as described in U.S. Pat. No. 5,284,703, by C. H. Everhart, et al., entitled "High Pulp Content Nonwoven Composite Fabric", the entire content of which is incorporated herein by reference.

Useful multi-layer materials may be made by joining at least one absorbent nonwoven fabric with at least one reinforcing fabric. For example, an absorbent web of meltblown fibers (which may include meltblown microfibers) may be joined with at least one spunbonded continuous filament web (i.e., reinforcing fabric). An exemplary multi-layer seamless material useful for making the liquid-distribution garment of the present invention is a nonwoven laminated fabric constructed by bonding together layers of spunbonded continuous filaments webs (i.e., reinforcing layers) and webs of meltblown fibers (i.e., absorbent nonwoven webs) which may include meltblown microfibers. The multi-layer material may also include a bonded carded web or other nonwoven fabric. This material is so inexpensive to produce that it may be considered to be a disposable material.

An exemplary three-layer fabric having a first outer ply of a spunbonded web (i.e., reinforcing layer), a middle ply of an absorbent meltblown web (i.e., absorbent nonwoven fabric), and a second outer ply of a spunbonded web (i.e., reinforcing layer) may be referred to in shorthand notation as SMS. The fibers and/or filaments in such fabrics may be thermoplastic polymers such as, for example, polyolefins, polyesters, and polyamides. If polyolefins are used for the fibers and/or filaments, desirable polyolefins include polyethylene, polypropylene, polybutene, ethylene copolymers, polypropylene copolymers and butene copolymers, as well as blends and copolymers including the foregoing. Desirably, the polyolefin may be a random block copolymer of propylene and ethylene which contains about 3 percent or more, by weight, ethylene. The fibers and/or filaments may be formed from blends that contain various pigments, additives, strengthening agents, flow modifiers and the like. Such fabrics are described in U.S. Pat. Nos. 4,041,203, 4,374,888, and 4,753,843, the contents of which are incorporated herein by reference.

The multi-layer sheet material (which is desirably a seamless multi-layer sheet material) may have a total basis weight of between about 15 gsm to about 300 gsm. For example, the multi-layer sheet of material may have a basis weight ranging from about 40 gsm to about 175 gsm. Desirably, the multi-layer sheet of material may have a basis weight ranging from about 50 gsm to about 150 gsm.

For example, the multi-layer sheet of material may be a multi-layer seamless nonwoven web of spunbond-meltblown-spunbond (SMS) construction in which each layer has a basis weight from about 9 gsm to about 70 gsm. Desirably, each layer may have a basis weight of from about 12 gsm to about 34 gsm. More desirably, each layer may have a basis weight of from about 14 gsm to about 27 gsm.

Exemplary multi-layer sheet materials which may be used in the manufacture of the liquid-distribution garments of the present invention include fabrics available from the Kimberly-Clark Corporation under the trade designation KLEENGUARD® nonwoven fabrics (i.e., surfactant treated or wettable KLEENGUARD® nonwoven fabrics). These fabrics are nonwoven laminated fabrics constructed by bonding together layers of spunbonded continuous filaments webs and webs of meltblown fibers (including meltblown microfibers). The fabrics may also include a bonded carded web or other nonwoven material. The KLEENGUARD® nonwoven fabrics are typically composed of a first outer ply of a spunbonded polypropylene continuous filament web, a middle ply of a meltblown polypropylene web, and a second outer ply of a spunbonded polypropylene continuous filament web. These plies are joined together by conventional thermal bonding techniques utilizing heat and pressure. Such fabrics are described in U.S. Pat. Nos. 4,041,203, 4,374,888, and 4,753,843, previously incorporate by reference.

Desirably, these reinforcing fabrics and/or the absorbent nonwoven webs are hydrophilically transmuted. That is, the fabrics or webs are formed of hydrophobic materials that have been rendered hydrophilic by internal wetting agents, external wetting agents and/or surface modification. It is contemplated that the reinforcing fabric may remain in its hydrophobic state (i.e., may not be hydrophilically transmuted) in the practice of the present invention as long as the reinforcing fabric allowed sufficient amounts of moisture to transfer to the absorbent nonwoven web so that the liquid-distribution garment could have the desired water wicking performance and the desired water capacity performance.

Exemplary internal wetting agents include siloxane additives and various surfactants having a (hydrophilic lypophilic balance) HLB number in the range of from 8 to 20 and a molecular weight in the range of from 200 to 4000, that are only semi-compatible with a thermoplastic polymer. Exemplary siloxane additives are disclosed by, for example, U.S. Pat. Nos. 4,857,251; 4,920,168; 4,923,914; 5,057,262; 5,114,646; 5,120,888; 5,145,726; 5,149,576; 5,178,931; 5,178,932; 5,344,862; and 5,283,023; the contents of which are incorporated herein by reference. Exemplary surfactants having a (hydrophilic lypophilic balance) HLB number in the range of from 8 to 20 and a molecular weight in the range of from 200 to 4000, that are only semi-compatible with the thermoplastic polymer are disclosed by, for example, U.S. Pat. Nos. 3,973,068 and 4,070,218; the contents of which are incorporated herein by reference.

The reinforcing fabric may be hydrophilically transmuted utilizing an external wetting agent. Exemplary external wetting agents include, for example, applied surfactant treatments. Useful surfactants may be selected from, for example, anionic surfactants and cationic surfactants. As an example, dioctylester of sodium sulfosuccinic may be used. Disclosure of external wetting agents may be found in, for example, U.S. Pat. Nos. 4,426,417; 4,298,649 and 5,057,361; the contents of which are incorporated herein by reference. Alternatively and/or additionally, the reinforcing fabric and/or the absorbent nonwoven web may be hydrophilically transmuted by surface modification. Exemplary surface modification techniques include, for example, corona discharge treatments, chemical etches, coatings, and the like.

Different types of materials were tested for suitable liquid distribution properties to assess how they would perform in the liquid-distribution garments of the present invention. Water wicking rates and water capacity were measured for four different materials.

One material tested was a hydrophilically transmuted three-layer laminate of nonwoven fabrics. The two exterior layers are nonwoven webs of spunbonded polypropylene filaments sandwiching an interior layer which is a web of meltblown polypropylene fibers (i.e., a conventional SMS construction). The spunbonded layers each had a basis weight of approximately 13 gsm (~0.4 osy) and the meltblown layer had a basis weight of approximately 11 gsm (~0.3 osy). The overall basis weight of the material was approximately 38 gsm (~1.1 osy). The fabric contained approximately 0.25 percent, by weight, of a surfactant. The surfactant was a mixture of about 80 percent, by weight diocyls sodium sulfosuccinate and about 20 percent, by weight, ethoxylated nonylphenol available from Finetex® of Spencer, N.C. The surfactant-treated fabric is available under the designation KLEENGUARD® nonwoven fabrics (i.e., wettable KLEENGUARD® nonwoven fabrics) from Kimberly-Clark Corporation, Roswell, Ga. The results of testing are reported in Table 1.

Another material tested was a hydrophilically transmuted meltblown polypropylene fabric having a basis weight of approximately 68 gsm (~2.0 osy). The fabric contained approximately 0.75 percent, by weight, of a surfactant. The surfactant was dioctylester of sodium sulfosuccinic available under the designation Aerosol OT-75 from American Cyanamide of Wayne, N.J. The surfactant-treated fabric is available under the designation KIMTEX® from Kimberly-Clark Corporation, Roswell, Ga. The results of testing are reported in Table 2.

Another material tested was a three-layer laminate of nonwoven fabrics that was hydrophobic. The two exterior layers are nonwoven webs of spunbonded polypropylene filaments sandwiching an interior layer which is a web of meltblown polypropylene fibers. The spunbonded layers each had a basis weight of approximately 14 gsm (~0.4 osy) and the meltblown layer had a basis weight of approximately 12 gsm (~0.4 osy). The overall basis weight of the material was approximately 41 gsm (~1.2 osy). This material was not treated to enhance wettability. This material is available under the designation 1.2 SMS from Kimberly-Clark Corporation, Roswell, Ga. The results of testing are reported in Table 3.

The other material tested was a lightweight knit cotton material commonly found in "T-shirts" (i.e., undershirts). The knit cotton material was hydrophilic. The overall basis weight of the material was approximately 148 gsm (~4.4 osy). This material was not treated to enhance wettability. This material was obtained from packages of commercially available conventional cotton knit "T-shirts" or undershirts. The results of testing are reported in Table 4.

The percent water capacity test results found in each Table was also normalized for basis weight of the fabrics and is reported as grams of water per unit of basis weight (i.e., $grams_{water}$/gsm).

As can be seen from a comparison of fabrics, the untreated three-layer laminate (i.e., the untreated polypropylene SMS material—Table III) provided no measurable water wicking data. That material did have a normalized water capacity of about 6.1 g/gsm. The conventional knit cotton "T-shirt" or undershirt material (Table IV) had relatively low water wicking properties. The cotton knit was able to wick water at a rate of about 2.1 cm per 30 seconds in at least one direction; 2.7 cm per 45 seconds in at least one direction; and 3.2 cm per 60 seconds in at least one direction. The material had a normalized water capacity of 1.8 g/gsm.

The surfactant treated meltblown fabric (i.e., Kimtex® material—Table II) was able to wick water at a rate of about 2.9 cm per 30 seconds in at least one direction; 3.2 cm per 45 seconds in at least one direction; and 3.6 cm per 60 seconds in at least one direction. The material had a normalized water capacity of 8.2 g/gsm. This normalized water capacity was significantly better than the knit cotton "T-shirt" material (Table IV) and about 36 percent better than the untreated SMS material (Table III). The water wicking properties showed relatively little improvement over the knit cotton "T-shirt" material.

The hydrophilically transmuted three-layer laminate of nonwoven fabrics (Table I) exhibited excellent water wicking properties and excellent water capacity. This material is an exemplary material used in the practice of the present invention (i.e., used in the liquid-distribution garments of the present invention). Importantly, this material was able to wick water at a rate of about 4.4 cm per 30 seconds in at least one direction; 5.3 cm per 45 seconds in at least one direction; and 6.0 cm per 60 seconds in at least one direction. The material also had a normalized water capacity of 9.0 g/gsm. This normalized water capacity was significantly better than the knit cotton "T-shirt" material (Table IV), about 48 percent better than the untreated SMS material (Table III), and about 10 percent better than the Kimtex® material (Table II). The water wicking properties showed significant improvement over the knit cotton "T-shirt" material and, when compared to the Kimtex® material, was about 52 percent better at the 30 second water wicking mark; about 65 percent better at the 45 second water wicking mark; and about 67 percent better at the 60 second water wicking mark.

As can be seen from these results, when the hydrophilically transmuted three-layer laminate of nonwoven fabrics is constructed into the liquid-distribution garments of the present invention which are worn in body-side combination with substantially impervious protective apparel, good water wicking performance is available to distribute perspiration throughout the garment. In addition, good water capacity performance is available to hold perspiration in the garment. This combination of water wicking performance and water capacity performance is an improvement over conventional garments typically worn under substantially impermeable protective apparel.

Although the inventors should not be held to a particular theory of operation, it is thought that fabrics or webs formed of hydrophobic materials that have been rendered hydrophilic by internal wetting agents, external wetting agents and/or surface modification function well when converted into a liquid-distribution garment because they distribute liquid while not suffering from the effects of prolonged exposure to aqueous liquids that may be observed with some cellulosic, water swellable and/or partially water soluble fibers. Exposure to aqueous liquids may cause such fibers to become limp, droopy and/or so totally permeated with liquid that fabrics containing such fibers become clingy, clammy and otherwise uncomfortable to a wearer.

It is also generally thought that the multi-layer construction of the fabric used in the liquid-distribution garments provides advantages. In particular, the reinforcing layer (e.g., web of spunbond filaments) may be used to help isolate the absorbent nonwoven web from the body of the wearer. This may promote a desirable "dry" feeling or sensation. It is thought that this phenomena may be enhanced by the use of textured or crimped spunbond filaments. For example, crimped multi-component spunbond filaments may be used. Exemplary multi-component spunbond filaments are disclosed by U.S. Pat. No. 5,382,400 to Pike et al., the contents of which is incorporated herein by reference.

The reinforcing layer may serve as a transfer layer to wick moisture away from the skin into the absorbent nonwoven web while providing abrasion resistance and good tactile aesthetics. If continuous filaments such as, for example, continuous spunbond filaments are used as the reinforcing fabric, the filaments may also enhance the liquid distribution properties (e.g., the water wicking rate) of the material.

The material used in the liquid-distribution garments of the present invention should be breathable. That is, air should be able to pass through the material. Desirably, air contained within the substantially impermeable protective apparel (i.e., air trapped underneath the protective outer suit) may be pumped by body motion and movement of the liquid-distribution garment to help evaporate perspiration. It is thought that better removal of perspiration and/or the movement of air trapped within the substantially impermeable protective garment could help delay the onset of heat stress. Furthermore, the liquid distribution garment eliminates the need to wear conventional clothing beneath the substantially impermeable protective garment, thus eliminating one or more insulating layers that can help accelerate the onset of heat stress as well as alleviate laundering expenses.

In an aspect of the present invention, the liquid-distribution garment may include portions, sections, subsection, regions or layers that contain superabsorbent material. For example, the garment may contain discrete panels in the garment composed of a superabsorbent-containing laminate, a superabsorbent coform, or the like. Alternatively and/or additionally, the garment may include superabsorbent-containing patches or panels attached to the exterior of the liquid distribution garment (but within the substantially impermeable protective apparel). These patches or panels may be strategically located at points where perspiration tends to collect. It is contemplated that these patches or panels may be removably attached (e.g., utilizing hook and loop fasteners, snaps or the like) and could be exchanged for fresh superabsorbent when the patches or panels reach their absorptive capacity.

The foregoing description relates to several embodiments of the present invention pertaining to liquid-distribution garments that are worn in body-side combination with substantially impermeable disposable protective apparel, and modifications or alterations may be made without departing from the spirit and scope of the invention as defined in the following claims.

TABLE I

Hydrophilically Transmuted SMS Material

| | % Water Capacity % | Water Wick CD 15 SEC CM | Water Wick CD 30 SEC CM | Water Wick CD 45 SEC CM | Water Wick CD 60 SEC CM |
|---|---|---|---|---|---|
| | 348.010 | 3.000 | 4.400 | 4.800 | 5.500 |
| | 353.465 | 2.600 | 4.000 | 4.400 | 5.500 |
| | 345.213 | 2.800 | 4.000 | 4.400 | 5.500 |
| | 325.707 | 3.300 | 4.100 | 4.700 | 5.400 |
| | 314.657 | 3.200 | 4.000 | 4.600 | 5.300 |
| Mean | 337.410 | 2.980 | 4.100 | 4.580 | 5.440 |
| S.D. | 16.475 | 0.286 | 0.173 | 0.179 | 0.089 |

| | | Water Wick MD 15 SEC CM | Water Wick MD 30 SEC CM | Water Wick MD 45 SEC CM | Water Wick MD 60 SEC CM |
|---|---|---|---|---|---|
| | | 3.500 | 4.700 | 5.300 | 6.000 |
| | | 3.300 | 4.500 | 5.400 | 6.300 |
| | | 3.100 | 4.200 | 5.100 | 5.900 |
| | | 3.200 | 4.500 | 5.200 | 6.000 |
| | | 3.100 | 4.300 | 5.300 | 5.900 |
| | Mean | 3.240 | 4.440 | 5.260 | 6.020 |
| | S.D. | 0.167 | 0.195 | 0.114 | 0.164 |

NORMALIZED WATER CAPACITY: 9.0 g/gsm

TABLE II

Hydrophilically Transmuted Meltblown Web

| | % Water Capacity % | Water Wick CD 15 SEC CM | Water Wick CD 30 SEC CM | Water Wick CD 45 SEC CM | Water Wick CD 60 SEC CM |
|---|---|---|---|---|---|
| | 583.586 | 2.000 | 2.500 | 2.800 | 3.200 |
| | 568.107 | 2.500 | 3.100 | 4.000 | 4.000 |
| | 569.012 | 2.200 | 2.600 | 3.000 | 3.400 |
| | 544.942 | 2.200 | 2.700 | 3.100 | 3.400 |
| | 564.828 | 2.400 | 2.900 | 3.300 | 3.300 |
| Mean | 566.095 | 2.260 | 2.760 | 3.240 | 3.460 |
| S.D. | 13.852 | 0.195 | 0.241 | 0.462 | 0.313 |

TABLE II-continued

| Hydrophilically Transmuted Meltblown Web | | | | | |
|---|---|---|---|---|---|
| | | Water Wick MD 15 SEC CM | Water Wick MD 30 SEC CM | Water Wick MD 45 SEC CM | Water Wick MD 60 SEC CM |
| | | 2.100 | 2.900 | 3.200 | 3.800 |
| | | 2.400 | 2.900 | 3.400 | 3.800 |
| | | 2.300 | 2.900 | 3.100 | 3.700 |
| | | 2.400 | 2.700 | 3.200 | 3.700 |
| | | 2.300 | 3.200 | 3.000 | 3.400 |
| | Mean | 2.300 | 2.920 | 3.180 | 3.680 |
| | S.D. | 0.122 | 0.179 | 0.148 | 0.164 |

NORMALIZED WATER CAPACITY: 8.2 g/gsm

TABLE III

| Hydrophobic SMS Material | | | | | |
|---|---|---|---|---|---|
| | % Water Capacity % | Water Wick CD 15 SEC CM | Water Wick CD 30 SEC CM | Water Wick CD 45 SEC CM | Water Wick CD 60 SEC CM |
| | 289.588 | N.M. | N.M. | N.M | N.M. |
| | 279.268 | N.M. | M.M. | N.M. | N.M. |
| | 252.900 | N.M; | N.M. | N.M. | N.M. |
| | 283.816 | N.M. | N.M. | N.M. | N.M. |
| | 145.905 | N.M. | N.M. | N.M. | N.M. |
| Mean | 250.296 | — | — | — | — |
| S.D. | 60.023 | — | — | — | — |
| | | Water Wick MD 15 SEC CM | Water Wick MD 30 SEC CM | Water Wick MD 45 SEC CM | Water Wick MD 60 SEC CM |
| | | N.M. | N.M. | N.M. | N.M. |
| | | N.M. | N.M. | N.M. | N.M. |
| | | N.M. | N.M. | N.M. | N.M. |
| | | N.M. | N.M. | N.M. | N.M. |
| | | N.M. | N.M. | N.M. | N.M. |
| | Mean | — | — | — | — |
| | S.D. | — | — | — | — |

NORMALIZED WATER CAPACITY: 6.1 g/gsm

TABLE IV

| Knit Cotton "T-Shirt" Material | | | | | |
|---|---|---|---|---|---|
| | Water Capacity % | Water Wicking 15 SEC CD CM | Water Wicking 30 SEC CD CM | Water Wicking 45 SEC CD CM | Water Wicking 60 SEC CD CM |
| | 291.325 | 0.600 | 1.100 | 1.500 | 2.100 |
| | 260.962 | 0.800 | 1.600 | 2.000 | 2.500 |
| | 282.831 | 0.500 | 1.500 | 2.100 | 2.500 |
| | 251.172 | 0.400 | 0.900 | 1.100 | 1.700 |
| | 283.923 | 1.000 | 2.200 | 2.700 | 3.200 |
| Mean | 274.043 | 0.660 | 1.460 | 1.880 | 2.400 |
| S.D. | 17.086 | 0.241 | 0.503 | 0.610 | 0.557 |
| | | Water Wicking 15 SEC MD CM | Water Wicking 30 SEC MD CM | Water Wicking 45 SEC MD CM | Water Wicking 60 SEC MD CM |
| | | 1.000 | 2.300 | 2.900 | 3.300 |
| | | 1.300 | 2.000 | 2.500 | 3.000 |
| | | 0.800 | 1.800 | 2.500 | 2.900 |
| | | 1.000 | 1.800 | 2.700 | 3.100 |
| | | 1.700 | 2.600 | 3.000 | 3.500 |

TABLE IV-continued

| Knit Cotton "T-Shirt" Material | | | | |
|---|---|---|---|---|
| Mean | 1.160 | 2.100 | 2.720 | 3.160 |
| S.D. | 0.351 | 0.346 | 0.228 | 0.241 |

NORMALIZED WATER CAPACITY: 1.8 g/gsm

What is claimed is:

1. A liquid-distribution garment worn in body-side combination with substantially impermeable protective apparel, the garment comprising:

a body portion constructed of a liquid pervious hydrophilic sheet material, said body portion defining a neck opening and configured to cover at least a portion of a user's body torso;

said hydrophilic sheet material including:

(i) at least one layer of a hydrophilically transmuted, liquid pervious reinforcing fabric comprising the body-side of the hydrophilic sheet material; and (ii) at least one layer of a hydrophilically transmuted, liquid pervious absorbent nonwoven fabric joined to the layer of reinforcing fabric so that the joined layers have a water wicking rate of at least about 4 centimeters per 30 seconds in at least one direction.

2. The garment according to claim 1, wherein the hydrophilically transmuted reinforcing fabric is selected from hydrophilically transmuted nonwoven fabrics, textile fabrics, knit fabrics, and apertured film-like materials.

3. The garment according to claim 2, wherein the nonwoven fabrics are selected from spunbonded webs and bonded carded webs.

4. The garment according to claim 1, wherein the reinforcing fabric is a hydrophobic fabric that is hydrophilically transmuted utilizing an internal wetting agent.

5. The garment according to claim 1, wherein the reinforcing fabric is a hydrophobic fabric that is hydrophilically transmuted utilizing an external wetting agent.

6. The garment according to claim 5, wherein the external wetting agent is an applied surfactant treatment.

7. The garment according to claim 6, wherein the surfactant is selected from anionic surfactants and cationic surfactants.

8. The garment according to claim 1, wherein the reinforcing fabric is a hydrophobic fabric that is hydrophilically transmuted by surface modification.

9. The garment according to claim 1, wherein the hydrophilically transmuted absorbent nonwoven fabric is selected from hydrophilically transmuted absorbent meltblown fiber webs, spunbonded webs and bonded carded webs.

10. The garment according to claim 9, wherein the meltblown fiber webs includes one or more additional materials selected from textile fibers, pulp fibers and particulate materials.

11. The garment according to claim 1, wherein the absorbent nonwoven fabric is a hydrophobic fabric that is hydrophilically transmuted utilizing an internal wetting agent.

12. The garment according to claim 1, wherein the absorbent nonwoven fabric is a hydrophobic fabric that is hydrophilically transmuted utilizing an external wetting agent.

13. The garment according to claim 12, wherein the wetting agent is an applied surfactant treatment.

14. The garment according to claim 13, wherein the surfactant is selected from anionic surfactants and cationic surfactants.

15. The garment according to claim 1, wherein the absorbent nonwoven fabric is a hydrophobic fabric that is hydrophilically transmuted by surface modification.

16. The garment according to claim 1, wherein the joined layers have a water wicking rate of at least about 5 centimeters per 45 seconds in at least one direction of the joined fabrics.

17. The garment according to claim 1, wherein the joined layers have a water wicking rate of at least about 6 centimeters per 60 seconds in at least one direction of the joined fabrics.

18. The garment according to claim 1, wherein the joined layers have a water capacity of at least about 8.5 grams for each gram per square meter of basis weight.

19. The garment according to claim 18, wherein the joined layers have a water capacity of at least about 9 grams for each gram per square meter of basis weight.

20. A liquid-distribution garment worn in body-side combination with substantially impermeable protective apparel, the garment comprising a body portion, sleeve portions and leg portions extending therefrom, at least one of said portions being formed from a material comprising:

at least one layer of a hydrophilically transmuted, liquid pervious reinforcing fabric comprising the body-side of the hydrophilic sheet material; and at least one layer of a hydrophilically transmuted, liquid pervious absorbent nonwoven fabric joined to the layer of reinforcing fabric so that the joined layers have a water wicking rate of at least about 4 centimeters per 30 seconds in at least one direction.

21. The garment of claim 20, wherein said portions further include sub-portions that contain superabsorbents.

22. The garment of claim 20, the garment being composed of multiple sections comprising:

a top section comprising a body portion and sleeve portions extending therefrom, and a bottom section comprising leg portions.

23. A liquid-distribution garment worn in body-side combination with substantially impermeable protective apparel, the garment comprising:

a first body half and a second body half, said second body half being substantially a mirror image of said first body half, each said body half being composed of a seamless sheet of material comprising at least one layer of a hydrophilically transmuted reinforcing fabric; and at least one layer of a hydrophilically transmuted absorbent nonwoven fabric joined to the layer of reinforcing fabric so that the joined layers have a water wicking rate of at least about 4 centimeters per 30 seconds in at least one direction, and each body half including:

a body portion having a first and second edge and a top edge extending approximately halfway across the body portion from the top of the second edge;

a sleeve portion having a top and bottom sleeve edge, a top edge, and a segment of the second edge of the body portion; and a leg portion having a front and a rear leg edge;

closure means joining the first edges of each body portion on each body half;

a seam joining the second edges of the body portion, including the segment of the second edges in the sleeve portions, on each body half;

sleeve seams joining the top sleeve edges to the bottom sleeve edges on each body half;

inseams joining the front leg edges to the back leg edges on each body half; and back seams joining each top edge of a sleeve portion with the top edge of its respective body portion on each body half.

24. The garment of claim 23, wherein said said garment further include sub-portions that contain superabsorbents.

25. A liquid-distribution garment worn in body-side combination with substantially impermeable protective apparel, the garment comprising a body portion constructed substantially entirely of a hydrophilic sheet material, said hydrophilic sheet material being pervious to liquid on both planar sides thereof and comprising at least one layer of a hydrophilically transmuted absorbent layer of nonwoven synthetic fibers and at least one hydrophilically transmuted, liquid pervious reinforcement layer of nonwoven synthetic fibers joined to the absorbent layer so that the joined layers have a water wicking rate of at least about 4 centimeters per 30 seconds in at least one direction.

26. The garment according to claim 25, wherein said at least one hydrophilically transmuted, liquid pervious reinforcement layer of nonwoven synthetic fibers is located adjacent one planar side of said absorbent layer and comprises the body-side of the hydrophilic sheet material.

27. The garment according to claim 26, wherein said at least one hydrophilically transmuted, liquid pervious reinforcement layer comprises two reinforcement layers, respectively located on opposite planar sides of said absorbent layer.

28. The garment according to claim 27, wherein said hydrophilic sheet material has a water capacity of about 8.5 grams for each gram per square meter of basis weight.

29. The garment according to claim 25, wherein said body portion has respective first and second sleeve portions attached thereto, said sleeve portions being constructed substantially entirely of said hydrophilic sheet material.

* * * * *